United States Patent [19]

Alameddine

[11] Patent Number: 4,962,814

[45] Date of Patent: Oct. 16, 1990

[54] OPTIMIZATION OF CYCLIC STEAM IN A RESERVOIR WITH INACTIVE BOTTOM WATER

[75] Inventor: Bassem R. Alameddine, Carrollton, Tex.

[73] Assignee: Mobil Oil Corporation, Fairfax, Va.

[21] Appl. No.: 413,809

[22] Filed: Sep. 28, 1989

[51] Int. Cl.[5] ..... E21B 33/138; E21B 43/24

[52] U.S. Cl. ..... 166/288; 166/50; 166/297; 166/300; 166/303

[58] Field of Search ..... 166/50, 270, 272, 273, 166/274, 288, 297, 300, 303

[56] References Cited

U.S. PATENT DOCUMENTS

| | | | |
|---|---|---|---|
| 3,147,805 | 9/1964 | Goodwin et al. | 166/288 |
| 3,324,946 | 6/1967 | Belknap | 166/303 X |
| 3,557,562 | 1/1971 | McLaughlin, Jr. et al. | 61/41 |
| 3,682,244 | 8/1972 | Bowman et al. | 166/303 X |
| 3,974,877 | 8/1976 | Redford | 166/288 X |
| 3,997,004 | 12/1976 | Wu | 166/272 X |
| 4,064,942 | 12/1977 | Prats | 166/263 X |
| 4,157,322 | 6/1979 | Colegrove | 166/270 |
| 4,160,481 | 7/1979 | Turk et al. | 166/303 |
| 4,482,015 | 11/1984 | Falk | 166/288 |
| 4,565,249 | 1/1986 | Pebdani et al. | 166/303 |
| 4,612,990 | 9/1986 | Shu | 166/272 |
| 4,658,898 | 4/1987 | Paul et al. | 166/270 |
| 4,716,966 | 1/1988 | Shu | 166/295 |

*Primary Examiner*—George A. Suchfield

*Attorney, Agent, or Firm*—Alexander J. McKillop; Charles J. Speciale; Charles A. Malone

[57] ABSTRACT

A process for preventing steam entry into a bottom water zone of a formation. Performations are made in a well which perforations communicate with the lowest level of said bottom water zone. Air is injected into the lowest level of said zone via said well which initiates low temperature oxidation thereby increasing the viscosity of said oil and making a heavy oil. When a desired viscosity is obtained, air injection is ceased. Said well is recompleted and perforations are placed in said well which causes it to communicate with a higher level oil saturated zone. Steam is injected into said higher level since the lowest level of the bottom water zone is closed because of the high viscosity oxidized oil. Thus, steam injection causes oil to be removed from the higher level of said formation.

23 Claims, 1 Drawing Sheet

OPTIMIZATION OF CYCLIC STEAM IN A RESERVOIR WITH INACTIVE BOTTOM WATER

RELATED APPLICATIONS

This application is related to copending application Ser. No. 068,290, filed July 1, 1987, now U.S. Pat. No. 4,804,043. It is also related to Ser. No. 292,795. Additionally, this application is related to Ser. No. 292,799.

FIELD OF THE INVENTION

This invention relates to the use of an oxidizing fluid to increase an oil's viscosity so that the oil can be used to prevent steam channelling into a non-aquifer bottom water zone which causes increased amounts of hydrocarbonaceous fluids to be obtained from an adjacent hydrocarbonaceous fluid bearing zone in a formation.

BACKGROUND OF THE INVENTION

In the recovery of oil from oil-containing formations, it is usually possible to recover only minor portions of the original oil-in-place by so-called primary recovery methods which utilize only natural forces. To increase the recovery of oil a variety of supplementary recovery techniques are employed. These techniques include waterflooding, miscible flooding, thermal recovery, and steam flooding.

A problem that arises in various flooding processes is that different strata or zones in the reservoir often possess different permeabilities. Thus, displacing fluids enter high permeability or "thief" zones in preference to zones of lower permeability. Significant quantities of oil may be left in zones of lower permeability. To circumvent this difficulty the technique of profile control is applied to plug the high permeability zones with polymeric gels and thus divert the displacing fluid into the low permeability, oil rich zones. Among the polymers examined for improving waterflood conformance are metal cross-linked polysaccharides, metal cross-linked polyacrylamides, and organic cross-linked polyacrylamides.

Another problem that arises when steam flooding a formation having a non-aquifer bottom water zone is that on occasion steam channels into the bottom water zone. This bottom water zone has relatively higher mobility which allows preferential steam entry. It is difficult to re-direct the steam into upper portions of the reservoir or formation since steam prefers the path of least resistance. The path of least resistance in this situation happens to be the bottom water zone. Another problem which arises is how to use a polymeric gel to close off an override area in a formation which has been swept by a steamflood.

Polymeric gels are disclosed in several U.S. patents. Among these is U.S. Pat. No. 4,157,322 which issued to Colegrove on June 5, 1979. This gel is formed from water, a polysaccharide polymer, an acid generating salt and a melamine resin. A polymeric gel is disclosed in U.S. Pat. No. 4,658,898 which issued to Paul and Strom on Apr. 21, 1987. This patent discloses an aqueous solution of heteropolysaccharide S-130 combined with inorganic cations which forms gels at elevated temperatures. U.S. Pat. No. 4,716,966, issued to Shu on Jan. 5, 1988, discloses a gel formed by amino resins such as melamine formaldehyde which modify biopolymers in combination with transitional metal ions. These patents are hereby incorporated by reference herein.

Basic to the problem of diverting displacing fluid with polymeric gels is the necessity of placing the polymer where it is needed, i.e. in the high permeability zone. This is not difficult if the gel is formed above ground. Xanthan biopolymers may be cross-linked with metal ions such as $Cr^{+3}$ above ground to give gels. These gels are shear thinning and can be injected into the formation where they then reheal. Since gel particles are being injected, they will of necessity go into high permeability zones. However, many other gel systems are formed in-situ. One system disclosed in U.S. Pat. No. 3,557,562 contains acrylamide monomer, methylene-bis-acrylamide as an organic cross-linker, and a free radical initiator. This system undergoes polymerization in the formation to give a polyacrylamide cross-linked with methylene-bis-acrylamide. However, the viscosity of the solution when injected is like that of water. Unless mechanical isolation is used, these solutions are quite capable of penetrating low permeability, oil bearing zones.

Another form of in-situ gelation involves the injection of polyacrylamide containing chromium in the form of chromate. A reducing agent such as thiourea or sodium thiosulfate is also injected to reduce the chromate in-situ to $Cr^{+3}$, a species capable of cross-linking hydrolyzed polyacrylamide. Even though the polyacrylamide solution has a viscosity greater than water, it is not capable of showing the selectivity that a gel can. Thus, polyacrylamides cross-linked with chromium in-situ can also go into low permeability zones. It is not useful to cross-link polyacrylamides above ground and inject them as gels, because polyacrylamide gels undergo shear degradation.

Therefore, what is needed is a method for preventing steam channelling in a bottom water zone where gels are not utilized which will allow steam to be re-directed into an upper zone of a reservoir so that hydrocarbonaceous fluids can be removed therefrom.

SUMMARY

This invention is directed to a method for optimizing steam injection into an oil containing reservoir which has a bottom water zone. In the practice of this method, an oxidizing fluid is injected into the bottom water zone in an amount and for a time sufficient to cause the residual oil to oxidize. Oxidation of the residual oil causes an increase in the viscosity of the residual oil which is sufficient to divert steam into an upper zone of the reservoir which contains oil. If necessary, oil with equal or smaller viscosity than reservoir oil is injected into the bottom water sand prior to oxidation.

Once the viscosity of the residual oil has been oxidized to the extent desired, injection of the oxidizing fluid is ceased. Thereafter, steam is injected into the reservoir. This steam proceeds into the reservoir and attempts to enter the bottom water zone which contains the oxidized oil. Being unable to enter this bottom water zone, the steam is directed into an upper oil containing zone. As the steam continues to flow through the upper oil containing zone, it carries with it oil which is produced to the surface. Thus, the thermal efficiency of a steam injection or steam stimulation method, e.g., "huff and puff" is substantially improved.

It is therefore an object of this invention to close off a bottom water zone without having to utilize gelatinous compositions.

It is another object of this invention to use oxidized oil to selectively close off a bottom water zone containing residual oils therein.

It is yet another object of this invention to increase the thermal efficiency of a steam injection or steam stimulation method when removing oil or hydrocarbonaceous fluids from a formation.

It is a still yet further object of this invention to use available materials to economically close off in a selective manner a bottom water zone.

DESCRIPTION OF THE PREFERRED EMBODIMENTS

Figure 2:
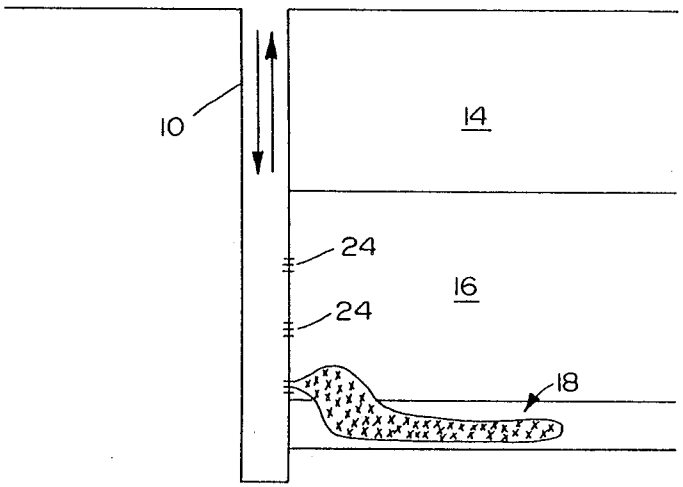
FIG. 2 is a diagrammatic plane view showing the lower bottom water zone partially closed with low temperature oxidized oil.
Figure 1:
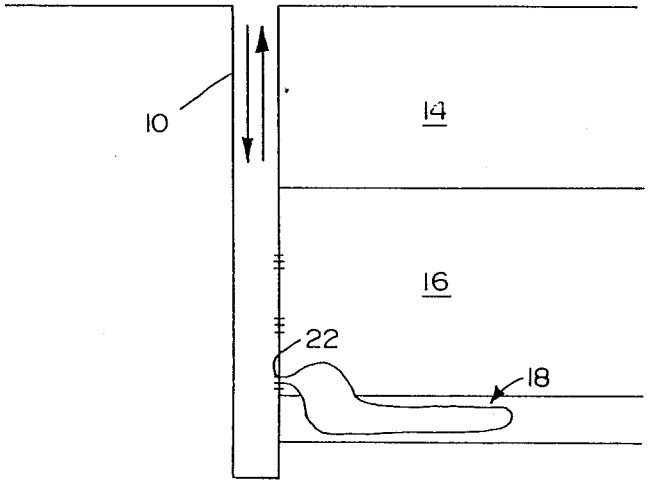
FIG. 1 is a diagrammatic plane view of a formation wherein steam is passed into a bottom water zone or area.

During the recovery of hydrocarbonaceous fluids or oil via a cyclic steam injection process, as is shown in FIG. 1, steam is injected into the injector well 10 and flows into the formation 16 via perforations 22. After entering zone 16, steam encounters resistance in zone 16 because the fluid mobility therein is less than in bottom water zone 18. Steam then channels into bottom water zone 18 where the mobility is substantially greater than in zone 16. Due to this, steam continually enters bottom water zone 18 without being able to contact additional hydrocarbonaceous fluids or oil in zone 16 thereabove.

A method of cyclically injecting steam is often referred to as a "push and pull" operation. Sometimes it is referred to as cyclic "steam injection" or "huff and puff" operations. In this process, steam is injected into the well to heat the formation so as to reduce the viscosity of oil therein. Afterwards, the well is shut in, and the viscous fluids along with steam are produced to the surface through the same well.

In order to maximize the thermal inefficiency and obtain a greater production of hydrocarbonaceous fluids or oil from the formation, an oxidation fluid is injected into wellbore 10 where it enters perforations 22 as is shown in FIG. 1. This oxidizing fluid can comprise air, oxygen, and mixtures thereof. Oxidizing fluid continues to enter bottom water zone 18 via perforations 22 until low temperature oxidation has taken place to an extent desired. The oxidating fluid is allowed to contact any residual oil in bottom water zone 18 in an amount and for a time sufficient to cause an increase in the viscosity of residual oil remaining in bottom water zone 18. After the oxidizing fluid has entered the bottom water zone 18 for a desired time, the oil therein will increase in viscosity. This increase in viscosity will be related to an increase in pressure in the oxidating fluid which is being injected into wellbore 10. When the pressure of the oxidating fluid has increased to the extent desired to obtain the desired viscosity increase, injection of the oxidizing fluid into wellbore 10 is terminated.

The oxidizing fluid can also have inert gases mixed with oxygen or air for combustion control. When injecting the oxidating fluid, the temperature of the formation should be less than about 200° F. so as to avoid combustion. The oxidation fluid which is injected into the formation should contain oxygen in the amount of from about 20% to about 50%. Higher amounts of oxygen can be used in the oxidating fluid depending upon the formation temperature. In order to keep the oxidating fluid from causing the formation to combust, an inert gas such as nitrogen or carbon dioxide can be mixed with the oxidation fluid to keep the concentration of the oxygen in a non-combustible state when contacting the oil in the bottom water zone.

After the oxidating fluid has been injected into the bottom water zone 18 for a time sufficient to obtain the desired increase in viscosity of the oil, injection of oxidating fluid is ceased. Afterwards, steam is injected into well 10 whereupon it enters zone 16 via perforations 24 since the lower perforations and water zone 18 have been closed by the oxidized oil. Steam is allowed to remain in the formation for a time sufficient to obtain the desired increase in the viscosity of the oil in said zone. This is obtained by shutting in the well for about 1 to about 12 days. Thereafter well 10 is reopened and oil and steam from formation 16 are produced to the surface via formation 24.

It is not necessary for bottom water zone 18 to be 100% saturated with water. Indeed, it is preferred to have some residual oil in bottom water zone 18 so as to decrease the fluid mobility therein so that a greater contrast exists between the oxidized oil in water bottom zone 18 and the mobility of fluids contained in upper zone 16. The greater the mobility contrast between bottom water zone 18 and upper oil containing zone 16, the more efficient will be the steam injection into upper zone 16. Of course, a lower concentration of oil to water in bottom water zone 18 decreases the potential that the process will work as envisioned. It is preferred to have a 50/50 mix of oil to water in lower bottom zone 18 prior to instituting low temperature oxidation. Once lower bottom water zone is closed by low temperature oxidation, the thermal efficiency of a steam injection or cyclic steam injection process will be greatly increased because steam is no longer lost into unproductive water bottom zone 18.

Where perforations do not exist in well 10 so as to allow communication with oil containing zone 16, the well can be recompleted at a higher level or a horizontal or radial well can be drilled into zone 16 to the extent desired prior to initiating cyclic steam injection.

In another embodiment where insufficient residual oil exists in bottom water zone 18, oil can be injected into well 10 so as to enter bottom water zone 18. The oil which is used can be from any sources commonly used to obtain oil (with equal or smaller viscosity than reservoir oil). But as is preferred, oil previously produced to the surface from formation 16 can be reinjected into well 10 so as to enter bottom water zone 18. In this manner, sufficient oil can be injected into bottom water zone 18 so as to obtain the desired saturation change in zone 18. The amount of oil injected into bottom water zone 18 as well as the amount of oxidizing fluid injected therein will be dependent upon conditions existing in a particular formation as those skilled in the art will readily recognize. While injecting the oxidating fluid into well 10, the process can be monitored by detecting the amount of carbon dioxide being produced from the formation by sampling gases exiting well 10 thereby avoiding combustion. An increase in the carbon dioxide concentration indicates that combustion has begun in the bottom water zone instead of low temperature oxidation of the oil in said zone. When this occurs, it is necessary to reduce the amount of oxygen being injected into formation 18 and cool down the reservoir.

Alternatively, an inert gas such as nitrogen or carbon dioxide can be injected into the formation.

Cyclic carbon dioxide steam stimulation oil recovery operations can also be commenced in zone 16 after plugging bottom water zone 18 by the low temperature oxidation method described above. A suitable process is described in U.S. Pat. No. 4,565,249 which issued to Pebdani et al. This patent is hereby incorporated by reference herein in its entirety.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

WHAT IS CLAIMED IS:

1. A method for optimizing steam injection into an oil containing reservoir having a bottom water zone comprising:

(a) injecting via a well an oxidizing fluid into the bottom water zone in an amount sufficient to oxidize oil in said zone which causes said oil to increase in viscosity sufficient to divert steam into an upper zone of the reservoir; and (b) ceasing injection of said fluid and commencing thereafter steam injection into the reservoir which steam is diverted from the bottom water zone and directed into an upper oil containing zone thereby improving steam injection thermal efficiency.

2. The method as recited in claim 1 where in step (b) steam is injected into said reservoir by perforating the well at a higher productive zone or by drilling at least one horizontal well into the reservoir.

3. The method as recited in claim 1 where steam is injected into the reservoir by at least one well which well is thereafter shut in and oil is produced subsequently from said well.

4. The method as recited in claim 1 where in step (a) oxygen is the oxidizing fluid.

5. The method as recited in claim 1 where in step (a) oxygen or air mixed with an inert gas comprises the oxidizing fluid.

6. The method as recited in claim 1 where after step (b) oil is produced from the reservoir.

7. The method as recited in claim 1 where in step (a) the oxidizing fluid is injected into a formation having a temperature of less than about 200° F.

8. The method as recited in claim 1 where in step (a) the oxidizing fluid contains about 20 to about 50% oxygen.

9. The method as recited in claim 1 where in step (a) said oxidizing fluid contains an inert gas in an amount sufficient to prevent combustion form occurring in said reservoir.

10. The method as recited in claim 1 where said bottom water zone contains a 50/50 mix of oil to water prior to instituting low temperature oxidation.

11. A method for optimizing steam injection into a bottom water zone of a formation or reservoir from which zone oil has been removed comprising;

(a) injecting oil into the bottom water zone via a well in an amount sufficient to saturate said water zone and displace water from said zone;

(b) injecting via the well an oxidizing fluid into said water zone in an amount and for a time sufficient to oxidize oil in said zone which causes said oil to increase in viscosity sufficient to divert steam into an upper zone of the reservoir; and (c) ceasing injection of said fluid and commencing thereafter steam injection into the reservoir which steam is diverted from the bottom water zone and directed into an upper oil containing zone thereby improving steam injection thermal efficiency.

12. The method as recited in claim 11 where in step (b) the oxidizing fluid is air, oxygen, and mixtures thereof.

13. The method as recited in claim 11 where in step (b) steam is injected into said reservoir by perforating the well at a higher productive zone or by drilling at least one horizontal well into the reservoir.

14. The method as recited in claim 11 where steam is injected into the reservoir by at least one well which well is thereafter shut in and oil is produced subsequently from said well.

15. The method as recited in claim 11 where after step (c) oil is produced from the reservoir.

16. The method as recited in claim 11 where in step (b) the oxidizing fluid is injected into a formation having a temperature of less than about 200° F.

17. The method as recited in claim 11 where in step (b) the oxidizing fluid contains about 20 to about 50% oxygen.

18. The method as recited in claim 11 where in step (b) said oxidizing fluid contains an inert gas in an amount sufficient to prevent combustion from occurring in said reservoir.

19. A method for optimizing steam injection into an oil containing reservoir or formation having a bottom water zone comprising:

(a) injecting via a well air into the bottom water zone in an amount sufficient to oxidize oil in said zone which causes said oil to increase in viscosity sufficient to divert steam into an upper zone of the reservoir; and (b) ceasing injection of air and commencing thereafter steam injection into the reservoir which steam is diverted from the bottom water zone and directed into an upper oil containing zone thereby improving steam injection thermal efficiency.

20. The method as recited in claim 19 where in step (b) steam is injected into said reservoir by perforating the well at a higher productive zone or by drilling at least one horizontal well into the reservoir.

21. The method as recited in claim 19 where steam is injected into the reservoir by at least one well which well is thereafter shut in and oil is produced subsequently from said well.

22. The method as recited in claim 19 where after step (b) oil is produced from the reservoir.

23. The method as recited in claim 19 where in step (a) said air is injected into a formation having a temperature of less than about 200° F.

* * * * *